US009589784B2

(12) United States Patent
Kaiser

(10) Patent No.: US 9,589,784 B2
(45) Date of Patent: Mar. 7, 2017

(54) ILLUMINANT AND OPERATING METHOD THEREFOR

(75) Inventor: Christoph Kaiser, Eggenstein-Leopoldshafen (DE)

(73) Assignee: KARLSRUHER INSTITUT FOR TECHNOLOGIE, Karlsruhe (DE)

( * ) Notice: Subject to any disclaimer, the term of this patent is extended or adjusted under 35 U.S.C. 154(b) by 905 days.

(21) Appl. No.: 13/976,208

(22) PCT Filed: Dec. 22, 2011

(86) PCT No.: PCT/DE2011/002167
§ 371 (c)(1),
(2), (4) Date: Sep. 11, 2013

(87) PCT Pub. No.: WO2012/095081
PCT Pub. Date: Jul. 19, 2012

(65) Prior Publication Data

US 2016/0172181 A1 Jun. 16, 2016

(30) Foreign Application Priority Data

Dec. 27, 2010 (DE) ..... 10 2010 056 028
Jan. 19, 2011 (DE) ..... 10 2011 008 944

(51) Int. Cl.
*H01J 7/46* (2006.01)
*H01J 19/80* (2006.01)
*H01J 65/04* (2006.01)

(52) U.S. Cl.
CPC ..... *H01J 65/042* (2013.01); *H01J 65/044* (2013.01)

(58) Field of Classification Search
None
See application file for complete search history.

(56) References Cited

U.S. PATENT DOCUMENTS

| | | | | |
|---|---|---|---|---|
| 4,049,940 | A | 9/1977 | Moisan et al. | |
| 4,792,725 | A | 12/1988 | Levy et al. | |
| 5,063,333 | A | 11/1991 | Linden-Smith et al. | |
| 2007/0194678 | A1 * | 8/2007 | Serita | H01J 9/247 313/112 |

FOREIGN PATENT DOCUMENTS

| | | | |
|---|---|---|---|
| DE | 10 2009 022 755 | | 2/2010 |
| DE | 10 2009 022 755 | | 12/2010 |
| JP | 10 255726 | | 9/1998 |
| JP | 2007 115547 | | 5/2007 |
| JP | 2007115547 A | * | 5/2007 |
| WO | 00/59694 | | 10/2000 |

(Continued)

OTHER PUBLICATIONS

K. Mando et al., "Application of an Antenna Excited High Pressure Microwave Discharge to Compact Discharge Lamps," J. Phys. D: Appl. Phys. 41 (2008) 144026 (10 pgs).

(Continued)

*Primary Examiner* — Anh Tran
(74) *Attorney, Agent, or Firm* — Salter & Michaelson

(57) ABSTRACT

The invention relates to an illuminant having a gas volume and a coaxial HF energy coupling device for the excitation thereof using surface waves. It is provided in this case that the coaxial HF energy coupling device (3) has a central conductor (4) guided in the gas volume (2).

20 Claims, 1 Drawing Sheet

(56) References Cited

FOREIGN PATENT DOCUMENTS

WO 2004/059694 7/2004

OTHER PUBLICATIONS

Barkhudarov, Edvard Mikhailovich et al., "Killing Bacteria Present on Surfaces in Films or in Droplets Using Microwave UV Lamps," World J Microbial Biotechnol. (2008) 24:761-769.
K. Mando et al., "Numerical Analysis of Antenna-Excited Microwave Discharge Lamp by Finite Element Method," 28th ICPIG Jul. 15-20, 2007 Prague, Czech Replublic.
Mizojiri, Takafumi et al., "Emission Properties of Compact Antenna-Excited Super-High Pressure Mercury Microwave Discharge Lamps," Japanese Journal of Applied Physics, vol. 46, No. 6A, 2007, pp. 3573-3578.
Mizojiri, Takafumi et al., "Compact Sulfur Lamps Operated by Antenna-Excited Microwave Discharge," Japanese Journal of Applied Physics, vol. 47, No. 10, 2008, pp. 8012-8016.
Kousaka, Hiroyuki et al., "Pressure Dependence of Surface Wave—Excited Plasma Column Sustained Along Metal Rod Antenna," Science Direct, Vacuum 80 (2006), pp. 1154-1160.
Bardos, L. et al., "Microwave Surfatron System for Plasma Processing," J. Vac. Sci Technol. A 14(2), Mar./Apr. 1996, pp. 474-477.
Zhang, X. L. et al., "A Self-Contained Modelling and Experimental Study of Surface Wave produced Argon Discharges in a Coaxial Setup with a Central Metallic Cylinder: II. Experiment," Plasma Sources Sci. Technol. 6 (1997) pp. 101-110.

* cited by examiner

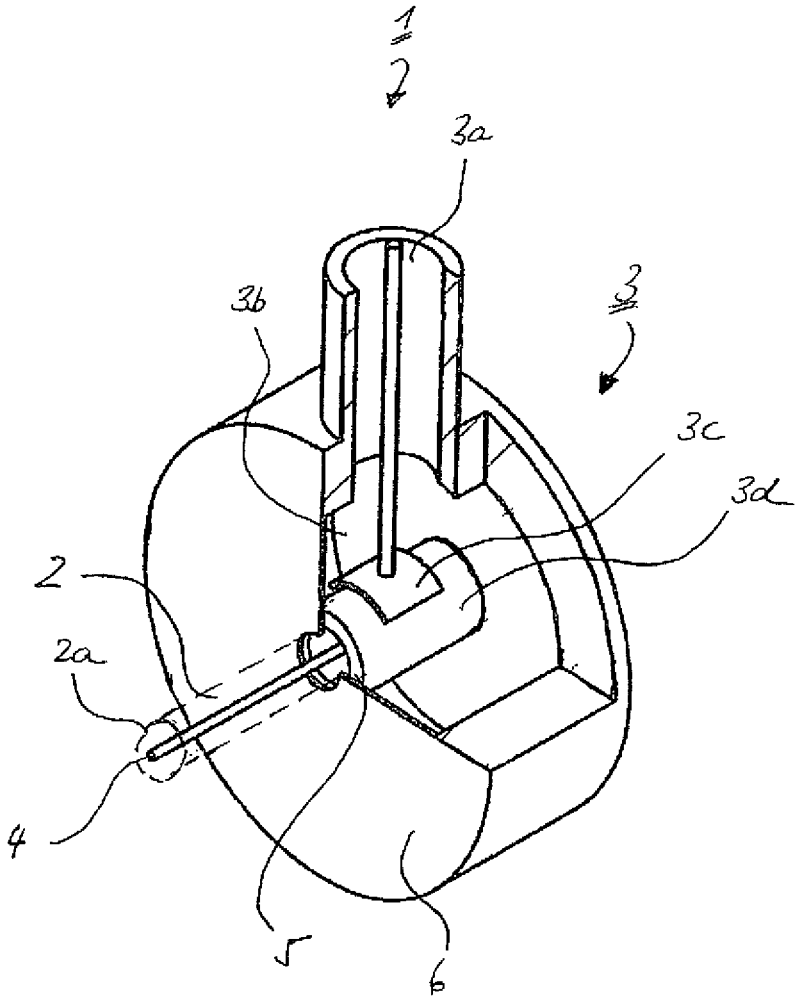
1
3a
3b
3
3c
3d
2
2a
4
5
6

ILLUMINANT AND OPERATING METHOD THEREFOR

TECHNICAL FIELD

The present invention relates to the subject matter claimed in the preamble and therefore relates to illuminants.

BACKGROUND OF THE INVENTION

Illuminants are understood in the present case as sources of optical radiation lying in the visible, ultraviolet, or infrared spectra, which are operated using electrical energy.

In principle, it is desirable to cause illuminants to illuminate very brightly with an acceptable power consumption. It has already been proposed that a gas volume be excited enough by supplying high-frequency electrical energy such that a luminescent plasma arises.

A device for plasma excitation using microwaves is known from DE 103 35 523 B4, in which a microwave conductor feed line branches and stud electrodes are formed therein, the length of which results in a microwave phase shift.

A plasma generation device which uses microwaves is also known, for example, from U.S. Pat. No. 4,908,492. A cylindrical HF conductor arrangement having a cylindrical outer conductor and a helical inner conductor, between which microwave energy is supplied is proposed therein. A discharge tube is to be arranged within the helical coil. Restrictions with respect to the dimensions and the shape are to be eliminated and a sufficient amount of power is to be coupleable into the gas or plasma, respectively. The use as a light source of high brightness and short wavelength for the purposes of optical reactions is mentioned.

A discharge tube arrangement having an excitation device and having a discharge tube is known from U.S. Pat. No. 5,072,157, which is formed from light-transmissive, dielectric material. The excitation device is designed for the purpose of exciting surface waves in the filling of the discharge tube. At least one impedance adaptation network is provided between a decoupling point and a high-frequency power source.

A device is known from U.S. Pat. No. 4,049,940, which is considered to be the closest prior art, in which a plasma is generated in a gas column by excitation of a surface wave using high-frequency energy. The surface wave generation means for the high-frequency energy coupling only extends over a part of the gas column and that such power is provided in the exciting electrical field that the generated plasma extends beyond the corresponding part of the gas column. In one exemplary embodiment, the gas column is contained in an elongated, insulated housing, wherein a first metallic tube, which is open on both sides, and a second tube, which encloses the first, so that a coaxial arrangement is obtained, are provided.

The microwave excitation of the gas volumes in illuminants according to the prior art is advantageous and desirable per se, because high luminances can thus be achieved, for example. However, it is disadvantageous that typically the use of resonant structures is necessary, which opposes the operation using more cost-effective broadband energy sources; in addition, shading of the light volume is often caused by the surrounding structures, or shielding of the coupled high-frequency energy is necessary, respectively.

It is desirable to at least partially remedy at least a part of the mentioned problems.

SUMMARY OF THE INVENTION

The solution to this problem is claimed in independent form. Preferred embodiments are found in the dependent claims.

The present invention therefore proposes, in a first basic idea, an illuminant having a gas volume and a coaxial HF energy coupling device, for the excitation of the gas volume with evanescent fields of surface waves, wherein it is provided that the coaxial HF energy coupling device has a central conductor guided in the gas volume.

Because a central conductor, i.e., a central conductor arranged on the axis of the coaxial HF energy coupling device, is used, the light generated by plasma lighting is firstly not shaded thereby.

It is to be noted that, although the central conductor preferably lies exactly centrally on the axis of the coaxial HF energy coupling device, deviations, preferably only slight deviations, from a central location are possible. This makes the illuminant more cost-effective in that possibly a lesser manufacturing precision is necessary. However, it is relevant that the gas volume encloses the central conductor; the light emitted from the plasma chamber is thus not shaded by the coupling structure.

The arrangement according to the invention generates particularly efficient surface waves, which is advantageous, since surface waves have at best a low electromagnetic radiation. Accordingly, shielding is not necessary or only very minor shielding measures must be used at most, respectively. This is advantageous in so far that the shielding has typically resulted in a significant reduction of the efficiency, i.e., the degree of efficiency of the lamps or illuminants operated by microwaves.

It is possible and preferable to design the gas volume as a high-pressure volume, in order to serve for lighting purposes. This is true in particular if an illuminant having high brilliancy, i.e., high color temperature and greater luminance, is desired. Interior lighting is to be mentioned here, for example, wherein a desired color temperature can possibly even be achieved by suitable gas fillings, etc. The pressure in the interior of high-pressure lamps can be several bar.

It is also to be noted that the present invention is also usable for low-pressure lamps, which operate using pressures in the range up to several millibars. Resulting UV radiation can also here be either directly emitted and used per se or converted via fluorescent materials into spectral ranges more suitable for the respective lighting and/or irradiation purposes.

Alternatively, it is possible to choose a moderate pressure for the gas volume, which is advantageous if the illuminant is to generate shortwave optical radiation, i.e., radiation lying in the ultraviolet spectrum, which is to be used directly or is to be converted into visible radiation—or example, via conventional fluorescent means. In this manner, for example, illuminants for generating biologically effective radiation, for example, for water disinfection in sewage treatment plants or for the food industry can be provided, as can illuminants, using which photochemical reactions can be triggered in paint shops or the like, i.e., for example, curing of coatings, adhesives, and the like is initiated.

It is to be noted that in the case of the illuminants of the present invention, they can obviously be provided, in particular the envelope bodies thereof, which typically consist of suitable types of glass, with fluorescent pigments, inter alia, in order to ensure the conversion of the UV radiation generated in the illuminant into the desired spectral ranges in a manner known per se.

It is to be noted that depending on the desired pressure range and intended use, the illuminant can be adapted accordingly. Thus, possibly dependent on the pressure, different thicknesses and/or different materials, for example, in the case of UV medium-pressure radiators, materials which are particularly highly UV transmissive, for example, quartz glass, can be chosen for the bulb surrounding the gas volume. It is to be noted that the gas volume is typically elongated, i.e., is arranged in an elongated cylinder or the like, for example.

The coaxial line is typically designed for the energy infeed or for the energy conduction, respectively, in the fundamental mode of the coaxial conductor. In so far, the illuminant of the present invention is therefore a non-resonant system, which in turn allows the illuminant to be operated in a broadband manner, i.e., for example, to use a broadband high-frequency energy source or even pulsed, also short pulsed energy. There is a substantial advantage over cavity resonator structures, since broadband pulsing is not possible therein because of the resonator property; therefore, short pulses, i.e., particularly broadband pulses, cannot be generated. In addition, by enabling a non-resonant excitation, a requirement which is thus reduced on the precision of the high-frequency energy source can also be achieved, which in turn reduces the costs.

A further advantage, which results by way of the possibility of non-resonant operation, is that no particular dimensions must be maintained for the components used, in order to meet any type of resonance conditions. This permits in particular the use of very small structures and thus achieves a high potential for miniaturization. In addition, even if the frequency of the high-frequency energy source varies slightly due to thermal effects or the like, for example, no or in any case no significant variation of the luminosity results, because the coupling of the electromagnetic wave into the plasma occurs in a practically frequency-independent manner.

The arrangement is typically designed in such a manner that power which is not required for plasma generation is reflected back. It is to be noted here that the possible power consumption of the illuminant varies according to the startup, for example, because the lamp must still be warmed up and thus energy-consuming processes are improved, for example, because the pressure is still increasing due to the heating or the like. In the case of high-pressure lamps, the pressure can rise to several hundred bar. The self-regulation by power reflection is advantageous in that a power regulator does not have to be connected upstream.

The energy transport into the plasma is performed by evanescent fields of the surface wave, so that galvanic coupling is not absolutely necessary. It is therefore particularly advantageous in the case of the arrangement according to the invention that the microwaves only have power to a significant extent at a small distance from the central conductor, which reduces the required shielding. Therefore, the central conductor can be galvanically connected to the gas volume, but this is not mandatory. Rather, it is preferable if the central conductor is not galvanically connected to the gas volume, but rather is galvanically isolated therefrom. This offers advantages, because the central conductor, in the event of galvanic isolation from the gas volume, also cannot come into contact with the plasma. Accordingly, the central conductor also cannot be attacked by the plasma—as electrodes otherwise are—which improves the durability.

In a particularly preferred variant, the central conductor protrudes beyond the coaxial jacket. The central conductor in the region protruding beyond the coaxial jacket here is still preferably located within the gas volume. The central conductor is therefore contained in the gas volume.

The gas illuminant chamber can be at least substantially, preferably completely free of shielding. Plasma excitation and surface wave formation can occur in the actual coupling structure, wherein the surface wave formed can extend along the central conductor beyond the shielding of the coupling structure along the central conductor, and wherein complete freedom from shielding is provided by the protrusion of the central conductor beyond the coaxial jacket, which encloses it at the beginning, at least in the region in which the central conductor protrudes beyond the jacket. Since high-frequency waves do not have to be shielded, light is also not shaded therein.

Protection is also claimed for a method for operating an illuminant, in which high-frequency energy is coupled via a coaxial central conductor into a gas volume, in particular in an arrangement as described in U.S. Pat. No. 4,049,940, however without the coaxial central conductor according to the invention therein.

It is particularly preferable in this case if high-frequency energy is coupled in a broadband or pulsed manner.

DESCRIPTION OF THE DRAWINGS

The invention will be described on the basis of the drawing hereafter only as an example. In the FIGURE FIG. 1 shows a coupling structure for an illuminant of the present invention.

DETAILED DESCRIPTION

According to FIG. 1, an illuminant 1, which is designated in general with 1, comprises a gas volume 2 and a coaxial HF energy coupling device 3 for exciting the gas volume 2 using surface waves, wherein the coaxial HF energy coupling device 3 has a central conductor 4 guided in the gas volume 2.

The illuminant 1 is filled in the present case as a low-pressure illuminant with a gas of 30 mbar here, using argon here, for example. The gas volume 2 is enclosed in an elongated glass bulb 2*a*, which is only indicated by dashed lines in FIG. 1. The glass bulb does not extend up into the interior of the coupling structure 3, but rather just only up close to it. A short-circuit of the microwave energy to be coupled to the inner conductor by the plasma is thus prevented. The central conductor 4 is located in this glass cylinder 2*a*, galvanically isolated from the further coupling structure 3.

The coupling structure 3 is formed in the present case, except for the central conductor 4, per se as described in U.S. Pat. No. 4,049,940. A similar coaxial energy feed line 3*a* is provided here, which is connected in the interior of a coupling chamber 3*b* with a capacitive coupling plate 3*c*, which regionally approaches closely to a coaxial jacket 3*d*. The coaxial jacket 3*d* has an axis, on which the central conductor 4 extends and accordingly forms a coaxial HF energy coupling device with the central conductor. Furthermore, the coupling structure 3 has a coupling slot 5 for applying the surface wave and a front plate 6. As the comparison to U.S. Pat. No. 4,049,940 shows, the present invention therefore differs in particular from the prior art by way of the additional central conductor 4. This intellectual property is moreover incorporated in its entirety for the purposes of disclosure.

The arrangement is operated as follows:

Energy is conducted via the coaxial feed line and the coaxial coupling toward the gas volume 2 via the coaxial feed line 1 from an HF energy source (not shown), which can be formed in the remaining part of the illuminant or separately. The capacitive coupling couples energy into the coaxial structure made of coaxial jacket 3*d* and central conductor 4 to relay energy in a coaxial fundamental mode.

By way of the supplied energy, a surface wave forms along the central conductor, which extends along the central conductor beyond the coupling structure and therefore also extends into the region of the elongated glass bulb outside the actual coupling structure, i.e., beyond the front plate 6, and the gas volume is set into the plasma state.

The coupling is performed without resonance conditions having to be maintained, so that pulsed operation is readily possible. Measurements have shown that no significant microwave power is emitted.

While in the present case the use of a bulb made of glass was described, this is not absolutely necessary. In particular, but not exclusively, for example, in the case of high-pressure lamps, the use of suitable ceramics also comes into consideration. The use of an internal conductor which is not galvanically isolated also rather comes into consideration for high-pressure illuminants having ceramic insulators.

In summary, an illuminant and a method for operating an illuminant were therefore described, in the case of which high-frequency waves are coupled into a gas volume to generate and maintain a plasma with only slight shading, a small construction is achieved, broadband transmission for high-frequency waves in the component is ensured, the intrinsic consumption or idle consumption is very low, and the high-frequency wave can be readily transported into the interior of the illuminant.

What is claimed is:

1. An illuminant comprising;

a gas volume contained in a glass bulb, said glass bulb forming a gas lighting chamber, an HF energy injection device for exciting the gas volume with surface waves and having a coupling structure which comprises a coaxial jacket, a front plate and a coupling slot for impressing the surface waves, said HF energy injection device further having a central conductor that is coupled into the gas volume, is isolated galvanically from the coupling structure and from the gas volume and is arranged on a longitudinal axis of the coaxial jacket, and said central conductor projecting beyond the coaxial jacket at a distance from the coupling structure, the central conductor in the region projecting beyond the coaxial jacket being located within the gas volume, in order therefore, during operation, to form a surface wave extending along the central conductor via the coupling structure of the coaxial HF energy injection device so as to set the gas volume into the plasma state.

2. An illuminant according to claim 1 wherein the gas volume is a high-pressure gas volume and is for illumination with high brilliance.

3. An illuminant according to claim 1 wherein the gas volume is a low-pressure gas volume and the lighting means is for one of UV generation and illumination.

4. An illuminant according to claim 1 wherein the gas volume is a low-pressure gas volume and the lighting means is for UV generation purposes and illumination purposes.

5. An illuminant according to claim 1 wherein the gas volume is a medium-pressure gas volume and is to generate one of biological and chemically active radiation.

6. An illuminant according to claim 1 wherein the gas volume is a medium-pressure gas volume and is to generate biological and chemically active radiation.

7. An illuminant according to claim 1 wherein the gas volume is for water disinfection with UV radiation.

8. An illuminant according to claim 1 wherein the center conductor is constructed and arranged for feeding and/or conducting energy in the fundamental mode.

9. An illuminant according to claim 1 wherein the gas volume is excited with non-resonant energy.

10. An illuminant according to claim 1 wherein the HF energy injection device is constructed and arranged to inject pulsed energy and/or broadband HF energy and/or comprises a pulsed or broadband HF energy source.

11. An illuminant according to claim 1 wherein the illuminant is constructed and arranged for self-regulation by power reflection.

12. An illuminant according to claim 1 wherein the gas lighting chamber is substantially free of any shielding.

13. An illuminant according to claim 1 wherein the front plate defines one side of a coupling chamber of the coupling structure with the coupling chamber being substantially cylindrical in shape and having a central coupling chamber axis.

14. An illuminant according to claim 13 wherein the coupling slot is formed in the front plate and has a coupling slot axis that is coincident with the central coupling chamber axis.

15. An illuminant according to claim 14 wherein the central conductor extends a major length of the glass bulb.

16. An illuminant according to claim 15 wherein the coupling chamber has a length as measured along the central coupling chamber axis that is less than a diameter of the coupling chamber.

17. An illuminant according to claim 1 wherein the front plate defines one side of a coupling chamber of the coupling structure with the coupling chamber having a central coupling chamber axis, wherein the coupling slot is formed in the front plate and has a coupling slot axis that is coincident with the central coupling chamber axis, wherein the coaxial jacket also has a coaxial jacket axis coincident with the central coupling chamber axis, and wherein a diameter of the coaxial jacket is less than a diameter of the coupling chamber.

18. An illuminant according to claim 17 wherein the diameter of the coaxial jacket is on the same order as a diameter of the coupling slot.

19. An illuminant according to claim 17 wherein the diameter of the coupling slot is less than the diameter of the coupling chamber.

20. A method for operating a lighting means according to claim 1, wherein the HF energy is injected in a broadband and/or pulsed manner.

* * * * *